US008997770B1

(12) United States Patent
Martin

(10) Patent No.: US 8,997,770 B1
(45) Date of Patent: Apr. 7, 2015

(54) WHEEL CHAIR COVERING DEVICE

(71) Applicant: Verna Martin, Bound Brook, NJ (US)

(72) Inventor: Verna Martin, Bound Brook, NJ (US)

( * ) Notice: Subject to any disclaimer, the term of this patent is extended or adjusted under 35 U.S.C. 154(b) by 0 days.

(21) Appl. No.: 14/105,432

(22) Filed: Dec. 13, 2013

(51) Int. Cl.
*E04H 15/06* (2006.01)
*A47C 7/62* (2006.01)
*A47C 7/66* (2006.01)

(52) U.S. Cl.
CPC . *E04H 15/06* (2013.01); *A47C 7/66* (2013.01)

(58) Field of Classification Search
USPC ..... 135/88.01, 88.12, 90, 96, 117, 119, 135/161, 67, 88.13; 280/304.1, 647; 297/184.1, 184.15; 180/2.2
See application file for complete search history.

(56) References Cited

U.S. PATENT DOCUMENTS

| | | | | |
|---|---|---|---|---|
| 3,116,808 | A * | 1/1964 | Riley | 182/129 |
| 3,170,665 | A | 2/1965 | Ryan | |
| 3,834,756 | A * | 9/1974 | Grell | 296/136.1 |
| 4,112,957 | A * | 9/1978 | Biven | 135/87 |
| 4,389,057 | A | 6/1983 | Richard, Jr. | |
| 5,168,889 | A | 12/1992 | Diestel | |
| 5,203,363 | A * | 4/1993 | Kidwell et al. | 135/90 |
| 5,582,458 | A * | 12/1996 | Wildt | 297/184.15 |
| 5,921,258 | A | 7/1999 | Francois | |
| 6,764,133 | B2 * | 7/2004 | Osato | 297/217.4 |
| 6,896,231 | B1 | 5/2005 | Sullivan, Sr. | |
| D532,343 | S | 11/2006 | Butler | |
| 7,140,678 | B1 | 11/2006 | Grant | |
| 7,185,375 | B1 * | 3/2007 | Movsas | 4/484 |
| 7,243,990 | B1 * | 7/2007 | Wahl | 297/184.15 |
| 7,316,450 | B2 | 1/2008 | Ayers et al. | |
| D591,069 | S * | 4/2009 | Martin | D6/361 |
| 7,861,735 | B2 | 1/2011 | Stepaniuk et al. | |
| 8,267,105 | B1 * | 9/2012 | Denmark, Jr. | 135/117 |
| 2002/0112752 | A1 * | 8/2002 | Blakney | 135/96 |
| 2006/0054207 | A1 * | 3/2006 | Wootliff | 135/96 |
| 2012/0192905 | A1 | 8/2012 | Boss | |

FOREIGN PATENT DOCUMENTS

| | | | | |
|---|---|---|---|---|
| CN | 202654328 | | 1/2013 | |
| DE | 102006025716 | | 1/2006 | |
| EP | 2417867 | | 2/2012 | |
| GB | 2445010 | | 6/2008 | |
| JP | 07207962 | A * | 8/1995 | E04H 1/12 |
| JP | 2005000615 | | 11/2007 | |
| KR | 1020020069429 | | 5/2010 | |

* cited by examiner

*Primary Examiner* — Winnie Yip

(57) ABSTRACT

A wheelchair covering device extends around a wheelchair to protect a user positioned in the wheelchair against inclement weather, such as rain, snow, sunlight and the like. The device includes a support unit configured for coupling to a wheelchair. A canopy is coupled to the support unit. The canopy is configured for extending over and shading a seat of the wheelchair. A flexible panel is removably coupled to the canopy. The panel is configured to extend around the seat of the wheelchair.

10 Claims, 5 Drawing Sheets

WHEEL CHAIR COVERING DEVICE

BACKGROUND OF THE DISCLOSURE

Field of the Disclosure

The disclosure relates to shading devices and more particularly pertains to a new shading device for extending around a wheelchair to protect a user positioned in the wheelchair against inclement weather, such as rain, snow, sunlight and the like.

SUMMARY OF THE DISCLOSURE

An embodiment of the disclosure meets the needs presented above by generally comprising a support unit configured for coupling to a wheelchair. A canopy is coupled to the support unit. The canopy is configured for extending over and shading a seat of the wheelchair. A flexible panel is removably coupled to the canopy. The panel is configured to extend around the seat of the wheelchair There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
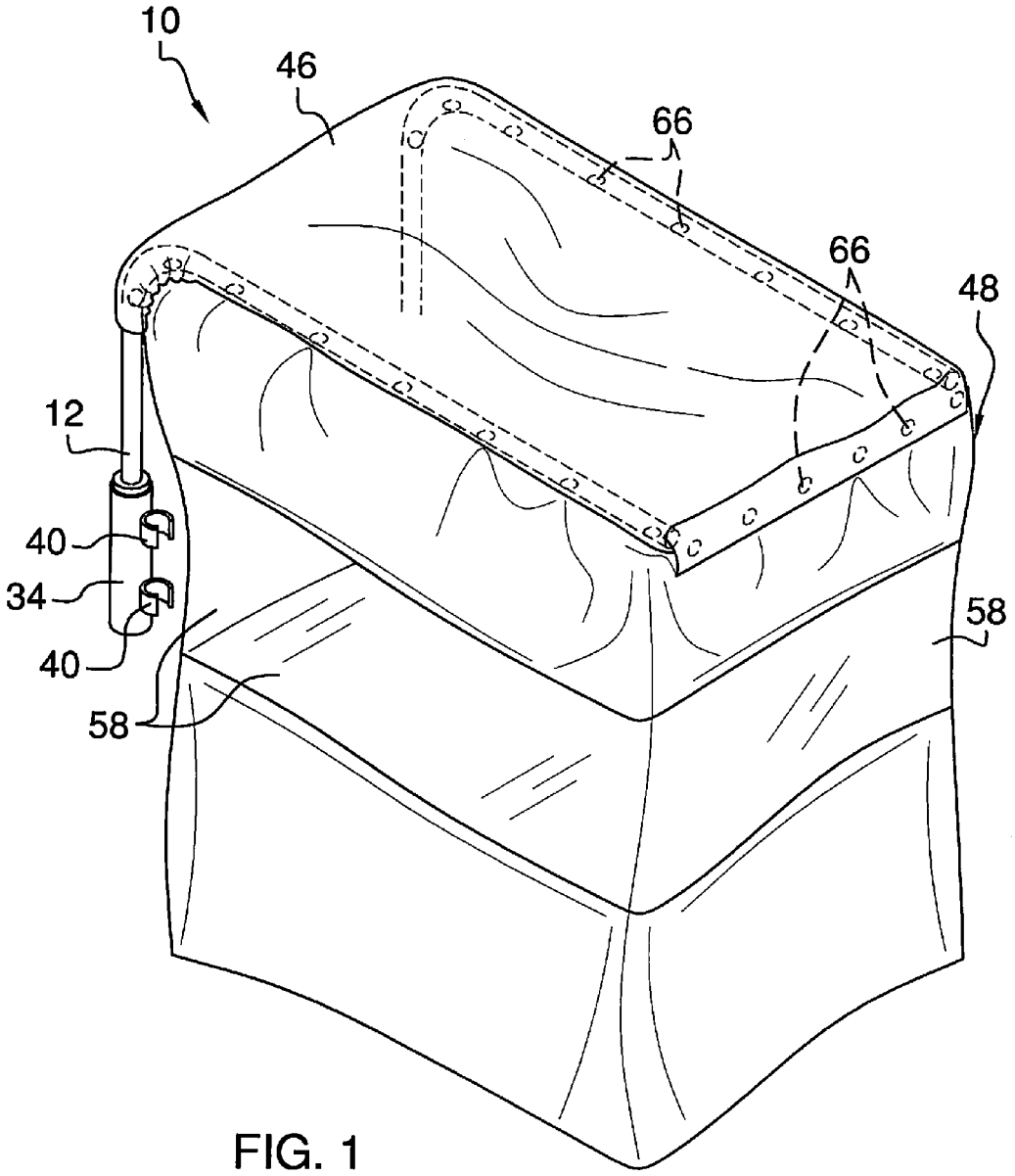
FIG. 1 is a top front side perspective view of a wheelchair covering device according to an embodiment of the disclosure.
Figure 2:
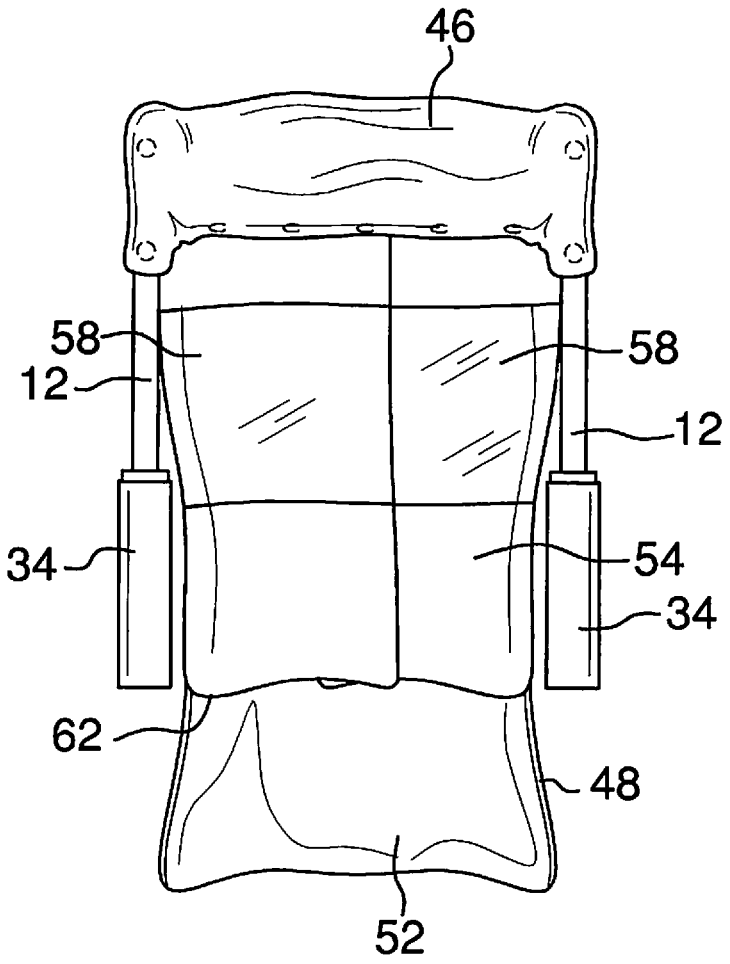
FIG. 2 is a back view of an embodiment of the disclosure.
Figure 3:
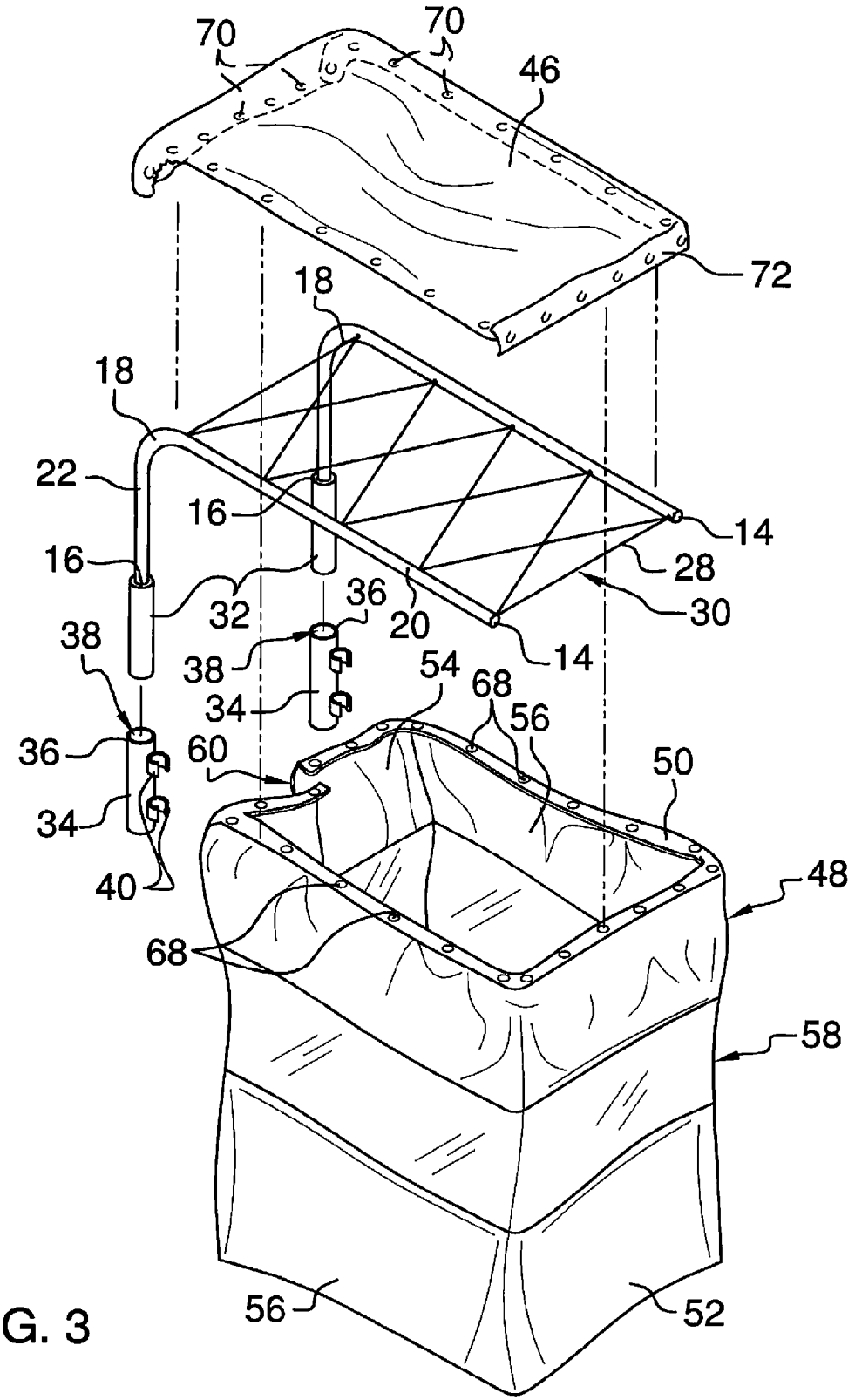
FIG. 3 is an exploded front perspective view of an embodiment of the disclosure.
Figure 4:
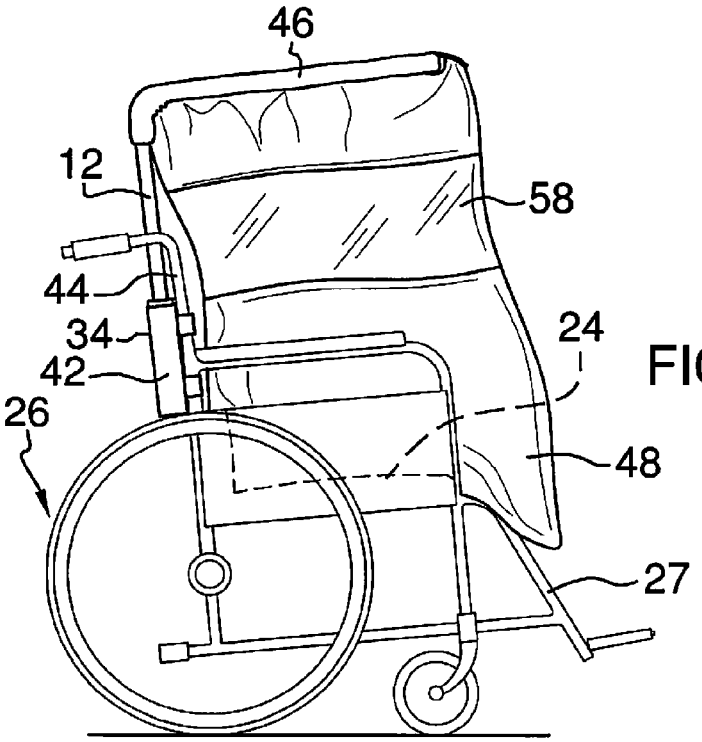
FIG. 4 is an in-use side view of an embodiment of the disclosure shown attached to a manual wheelchair.

With reference now to the drawings, and in particular to FIGS. 1 through 6 thereof, a new shading device embodying the principles and concepts of an embodiment of the disclosure and generally designated by the reference numeral 10 will be described.

Figure 5:
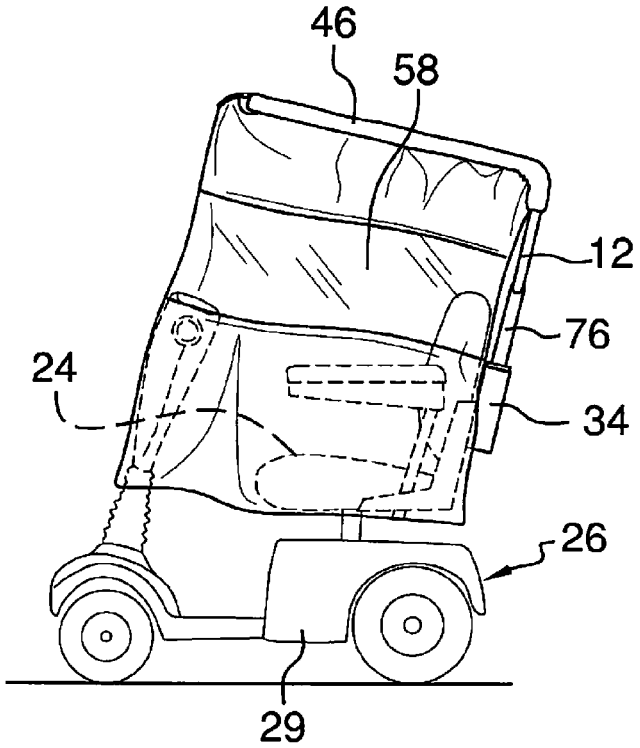
FIG. 5 is an in-use side view of an alternative embodiment of the disclosure shown attached to an electric-powered wheelchair.

As best illustrated in FIGS. 1 through 6, the wheelchair covering device 10 generally comprises a pair of spaced mounting poles 12. Each of the mounting poles 12 has a first end 14 and a second end 16. Each of the mounting poles 12 has a curved portion 18 positioned between the first 14 and second 16 ends of the associated mounting pole 12. Each curved portion 18 defines a horizontal upper portion 20 and a vertical lower portion 22 of the associated mounting pole 12. The horizontal upper portion 20 is configured to extend over a seat 24 of a wheelchair 26. The term wheelchair 26 is used here to include a manual wheelchair 27 of the type shown in FIG. 4, an electric-powered wheelchair 29 as shown in FIG. 5, or other wheeled chair devices. An open-weaved net 28 is coupled to and extends between the horizontal upper portion 20 of each mounting pole 12. The open-weaved net 28 and each of the mounting poles 12 defines a support unit 30.

A pair of tubular members 32 is provided. Each of the tubular members 32 is coupled to the second end 16 of an associated one of the mounting poles 12. A pair of receiving tubes 34 is provided. An upper end 36 of each of the receiving tubes 34 has an aperture 38 positioned therein. Each aperture 38 is configured to receive an associated one of the tubular members 32 therein. A plurality of clips 40 is provided. At least one of the clips 40 is coupled to each of the receiving tubes 34. The clips 40 are coupled to a perimeter wall 42 of an associated receiving tube 34. Each of the clips 40 may be arcuate. The clips 40 are configured to removably couple each of the receiving tubes 34 to an associated vertical upright 44 of the wheelchair 26.

A canopy 46 is couplable to the support unit 30. The canopy 46 is positionable on and extendable over the open-weaved net 28 and the horizontal upper portion 20 of each mounting pole 12. A flexible panel 48 is coupled to the canopy 46. The panel 48 is configured to extend around the seat 24 of the wheelchair 26. The panel 48 includes a top perimeter edge 50, a front section 52, a rear section 54 and a pair of side sections 56 coupled to and extending between the front section 52 and the rear section 54. The rear section 54 of the panel 48 may have a shorter length than the front section 52 and the side sections 56 of the panel 48.

The panel 48 includes a window portion 58. The window portion 58 is translucent to permit viewing through the window portion 58. The window portion 58 may extend a full distance around the panel 48 between the front section 52 and the rear section 54. In this manner, the window portion 58 allows the user positioned in the seat 24 of the wheelchair 26 to view out of the panel 48 in any desired direction. The window portion 58 may be constructed from a hard plastic or like material. A slit 60 extends between the top perimeter edge 50 of the panel 48 and a bottom edge 62 of the rear section 54 of the panel 48. The slit 60 extends transversely between the top perimeter edge 50 and the bottom edge 62 of the rear section 54.

A plurality of fasteners 66 removably couples the panel 48 and the canopy 46. The fasteners 66 comprise a plurality of first mating members 68 and a plurality of second mating members 70. The first mating members 68 are complementary relative to the second mating members 70 wherein the first 68 and second 70 mating members are selectively engageable to releasably couple the panel 48 and the canopy 46. The first mating members 68 are positioned on and extend around the top perimeter edge 50 of the panel 48. The second mating members 70 are positioned on and extend around a peripheral edge 72 of the canopy 46. The fasteners 66 may comprise snaps, hook and loop couplers or the like.

Figure 6:
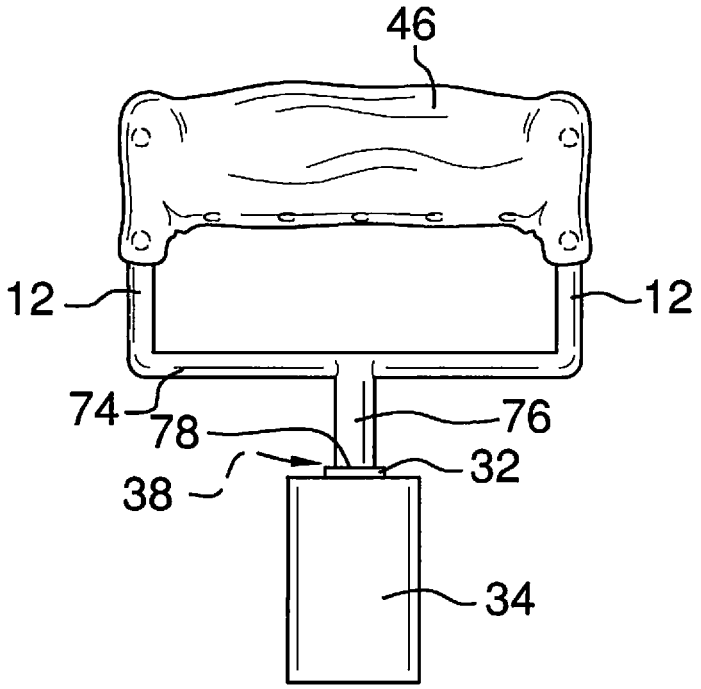
FIG. 6 is a back view of the alternative embodiment of FIG. 5 shown with the panel removed.

FIGS. 5 and 6 show an alternative embodiment of the invention particularly suited for use with the electric-powered wheelchair 29. Unless otherwise stated or mutually excluded, the alternative embodiment is identical to the embodiment shown in FIGS. 1-4. As shown in FIG. 6, the alternative embodiment includes a cross-bar 74 coupled to and extending between the second ends 16 of the mounting poles 12. A vertical post 76 is coupled to and extends downwardly from a center of the cross-bar 74. Instead of a pair of tubular members 32 and a pair of receiving tubes 34, the alternative embodiment includes only a single tubular member 32 and a single receiving tube 34. The tubular member 32 is coupled to a bottom end 78 of the vertical post 76. The upper end 36 of the receiving tube 34 has an aperture 38 positioned therein. The aperture 38 is configured to receive the tubular member 32 therein.

In use, as stated above and shown in the Figures, the canopy 46 is coupled to the support unit 30 as described above. Each of the tubular members 32 is positioned in the associated receiving tube 34 and attached to the wheelchair 26 using clips 40. The canopy 46 shields the user from inclement weather while the user is seated in the wheelchair 26. To further enhance the amount of shielding provided to the user, the panel 48 is attached to the canopy 46 using fasteners 66. In this manner, the device 10 enables a user who is bound in a wheelchair 26 to venture outdoors during inclement weather and be protected against the inclement weather.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A wheelchair covering device comprising:

a support unit configured for coupling to a wheelchair;

a canopy coupled to said support unit, said canopy being configured for extending over and shading a seat of the wheelchair;

a flexible panel being removably coupled to said canopy, said panel being configured to extend around the seat of the wheelchair;

wherein said support unit includes a pair of spaced mounting poles, each of said mounting poles having a first end and a second end, each of said mounting poles having a curved portion positioned between said first and second ends of said associated mounting pole, each said curved portion defining a horizontal upper portion and a vertical lower portion of said associated mounting pole, said horizontal upper portion being configured to extend over the seat of the wheelchair, said support unit further including an open-weaved net coupled to and extending between said horizontal upper portion of each said mounting pole, wherein said canopy is positionable on and extendable over said open-weaved net and said horizontal upper portion of each said mounting pole;

a cross-bar coupled to and extending between said second ends of said mounting poles;

a vertical post coupled to and extending downwardly from a center of said cross-bar; and a tubular member being coupled to a bottom end of said vertical post; and a receiving tube, an upper end of said receiving tube having an aperture positioned therein, said aperture being configured to receive said tubular member therein for removably coupling the support unit to the wheelchair.

2. The device of claim 1, further comprising a plurality of clips being coupled to said receiving tube, said clips being configured to removably couple said receiving tube to an associated vertical upright of the wheelchair.

3. The device of claim 1, further comprising said panel including front section, a rear section and a pair of side sections coupled to and extending between said front section and said rear section, said rear section of said panel having a shorter length than said front section and said side sections of said panel.

4. The device of claim 1, further comprising said panel including a window portion, said window portion being translucent to permit viewing through said window portion.

5. The device of claim 4, further comprising:

said panel including a front section, a rear section and a pair of side sections coupled to and extending between said front section and said rear section; and wherein said window portion extends a full distance around said panel between said front section and said rear section.

6. The device of claim 1, further comprising:

said panel including a top perimeter edge, a front section, a rear section and a pair of side sections coupled to and extending between said front section and said rear section; and a slit extending between said top perimeter edge of said panel and a bottom edge of said rear section of said panel, said slit extending transversely between said top perimeter edge and said bottom edge of said rear section.

7. The device of claim 1, further comprising a plurality of fasteners removably coupling said panel and said canopy, said fasteners comprising a plurality of first mating members coupled to said panel and a plurality of second mating members coupled to said canopy, said first mating members being complementary relative to said second mating members wherein said first and second mating members are selectively engageable to releasably couple said panel and said canopy.

8. The device of claim 7, further comprising said fasteners comprising a plurality of snaps.

9. The device of claim 7, wherein said first mating members are positioned on and extend around a top perimeter edge of said panel; and wherein said second mating members are positioned on and extend around a peripheral edge of said canopy.

10. A wheelchair covering device comprising:

a pair of spaced mounting poles, each of said mounting poles having a first end and a second end, each of said mounting poles having a curved portion positioned between said first and second ends of said associated mounting pole, each said curved portion defining a horizontal upper portion and a vertical lower portion of said associated mounting pole, said horizontal upper portion being configured to extend over a seat of a wheelchair;

an open-weaved net coupled to and extending between said horizontal upper portion of each said mounting pole, said open-weaved net and each of said mounting poles defining a support unit;

a pair of tubular members, each of said tubular members being coupled to said second end of an associated one of said mounting poles;

a pair of receiving tubes, an upper end of each of said receiving tubes having an aperture positioned therein, each said aperture being configured to receive an associated one of said tubular members therein;

a plurality of clips, at least one of said clips being coupled to each of said receiving tubes, said clips being coupled to a perimeter wall of an associated said receiving tube, each of said clips being arcuate, said clips being configured to removably couple each of said receiving tubes to an associated vertical upright of the wheelchair;

a canopy couplable to said support unit, said canopy being positionable on and extendable over said open-weaved net and said horizontal upper portion of each said mounting pole;

a flexible panel being coupled to said canopy, said panel being configured to extend around the seat of the wheelchair, said panel including a top perimeter edge, a front section, a rear section and a pair of side sections coupled to and extending between said front section and said rear section, said rear section of said panel having a shorter length than said front section and said side sections of said panel;

said panel including a window portion, said window portion being translucent to permit viewing through said window portion, said window portion extending a full distance around said panel between said front section and said rear section;

a slit extending between said top perimeter edge of said panel and a bottom edge of said rear section of said panel, said slit extending transversely between said top perimeter edge and said bottom edge of said rear section; and a plurality of fasteners removably coupling said panel and said canopy, said fasteners comprising a plurality of first mating members and a plurality of second mating members, said first mating members being complementary relative to said second mating members wherein said first and second mating members are selectively engageable to releasably couple said panel and said canopy, said first mating members being positioned on and extending around said top perimeter edge of said panel, said second mating members being positioned on and extending around a peripheral edge of said canopy, said fasteners comprising a plurality of snaps.

* * * * *